US005590424A

United States Patent [19]

Matsunaga et al.

[11] Patent Number: 5,590,424

[45] Date of Patent: Jan. 7, 1997

[54] DEVICE FOR PROVIDING SANITARY COVERS FOR TOILET SEATS

[75] Inventors: Masahiro Matsunaga, Ube; Hakuo Hamada, Nihonmatsu, both of Japan

[73] Assignees: M N Engineering Kabushiki Kaisya, Yamaguchi; Ube Jushi Kakou Kabushiki Kaisya, Fukushima, both of Japan

[21] Appl. No.: 255,671

[22] Filed: Jun. 8, 1994

[30] Foreign Application Priority Data

Jun. 10, 1993 [JP] Japan ..... 5-166446

[51] Int. Cl.[6] ..... A47K 13/14

[52] U.S. Cl. ..... 4/243.1; 4/244.1

[58] Field of Search ..... 4/243.1, 243.3, 4/244.1

[56] References Cited

U.S. PATENT DOCUMENTS 3,693,198 9/1972 Tromp ..... 4/243.1

FOREIGN PATENT DOCUMENTS 0256928 2/1913 Germany ..... 4/243.1
1-05326 11/1988 Japan .
2-45098 3/1990 Japan .
6-26691 4/1994 Japan .
9006715 6/1990 WIPO ..... 4/243.1

*Primary Examiner*—Charles E. Phillips
*Attorney, Agent, or Firm*—Morrison Law Firm

[57] ABSTRACT

A device provides a sanitary cover for a toilet seat when a toilet seat cover makes contact with a toilet seat as happens when the toilet seat cover is closed. The device includes a toilet seat cover which holds a plurality of toilet seat sanitary covers, and means for clamping a sanitary cover. The means for clamping are disposed at an end of the toilet seat and clamps a portion of a toilet seat sanitary cover when the toilet seat cover and the toilet seat make contact. The act of closing the toilet seat cover clamps a toilet seat sanitary cover kept inside the toilet seat cover and positions it on the toilet seat.

11 Claims, 7 Drawing Sheets

FIG. 4
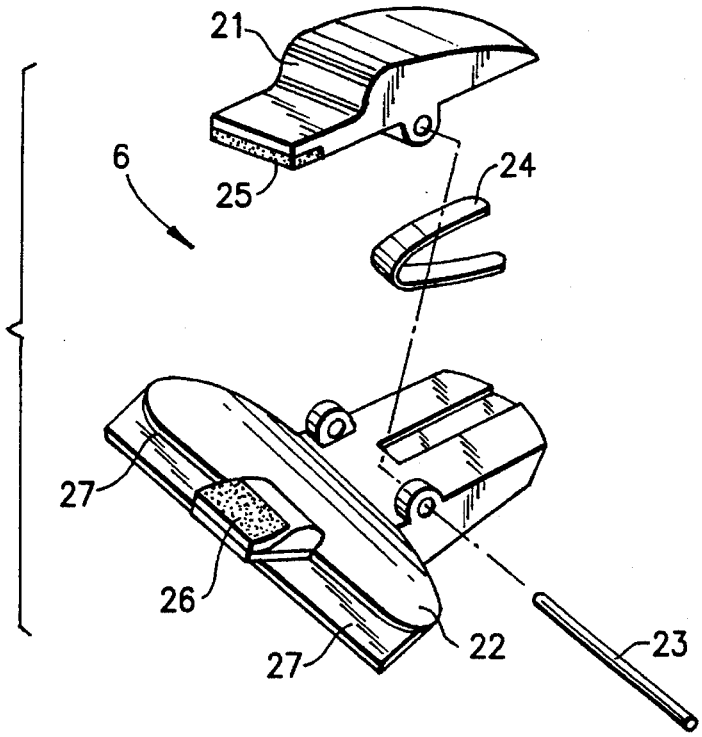
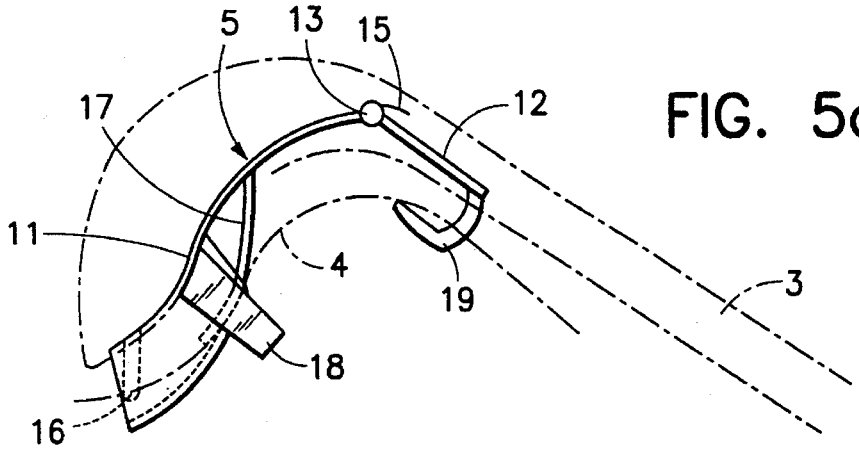
FIG. 5a
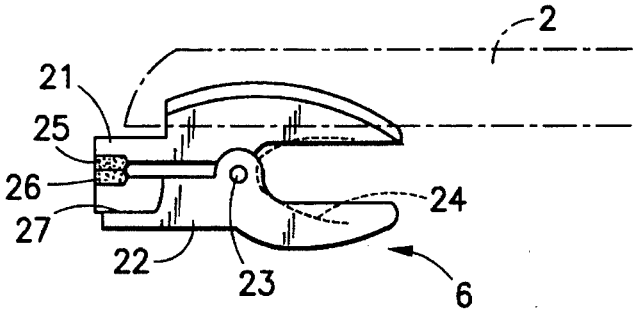
FIG. 5b

DEVICE FOR PROVIDING SANITARY COVERS FOR TOILET SEATS

BACKGROUND OF THE INVENTION

This invention relates to a toilet seat sanitary cover providing device. More specifically, this invention involves a device which provides a sanitary cover for a toilet seat when a toilet seat cover contacts a toilet seat as happens during the closing of the toilet seat cover.

Conventionally, in order to prevent users from feeling unsanitary, unclean, and the like, disposable types of toilet seat sanitary covers are provided in public rest rooms. Generally, in this case, people put a toilet seat sanitary cover on a toilet seat by themselves. However, sometimes people cannot easily put a toilet seat sanitary cover on the toilet seat properly, and sometimes the toilet seat sanitary cover does not stay in position when people sit on it.

Recently, an automatic toilet seat sanitary cover providing device was disclosed in Japanese Laid-open Patent Publication S63-294817. This device has a roller-shaped toilet seat sanitary cover kept in the back of toilet seat body. The roller-shaped toilet seat sanitary cover is pulled out to a desired length by means of a motor and the like. Another automatic toilet seat sanitary cover providing device has a bag-shaped film sanitary cover inserted inside one end of an O-type toilet seat. The film sanitary cover is pulled out from the end, covering the toilet seat, and then wound and kept at the other end.

However, in the automatic toilet seat sanitary cover providing devices mentioned above, pull out mechanisms are needed to provide a pre-determined length of toilet seat sanitary cover on the toilet seat. Mechanisms are also needed to cut a toilet seat sanitary cover at a predetermined length when a roller-shaped toilet seat sanitary cover is used. Controlling systems and operating systems are also needed to control these mechanisms. In addition, for large scale devices, a power supply is needed to operate these mechanisms.

Maintaining automatic toilet seat sanitary cover providing devices is troublesome. When using batteries to operate these devices, maintenance is still a problem since these batteries have to be changed periodically.

The inventors of the present invention have investigated the above-noted problems, studied various toilet seat sanitary cover providing methods, and discovered that these problems can be solved by having a toilet seat sanitary cover kept inside a toilet seat cover which provides a toilet seat sanitary cover when the toilet seat makes contact with the toilet seat cover.

OBJECTS AND SUMMARY OF THE INVENTION

It is an object of the present invention to provide a toilet seat sanitary cover providing device which overcomes the drawbacks of the prior art.

It is a further object of the present invention to provide a toilet seat sanitary cover providing device which can be simply constructed, easily maintained, and not be restricted by the lack of a power supply.

It is a further object of the present invention to provide a toilet seat sanitary cover providing device which can accurately provide a toilet seat sanitary cover onto a toilet seat.

It is a still further object of the present invention to provide a toilet seat sanitary cover providing device which can keep the toilet seat sanitary cover on the toilet seat.

Briefly stated, a device provides a sanitary cover for a toilet seat when a toilet seat cover makes contact with a toilet seat as happens when the toilet seat cover is closed. The device includes a toilet seat cover which holds a plurality of toilet seat sanitary covers, and means for clamping a sanitary cover. The means for clamping are disposed at an end of the toilet seat and clamps a portion of a toilet seat sanitary cover when the toilet seat cover and the toilet seat make contact. The act of closing the toilet seat cover clamps a toilet seat sanitary cover kept inside the toilet seat cover and positions it on the toilet seat.

According to an embodiment of the invention, a device for providing at least one of a plurality of sanitary covers for a toilet seat includes a toilet seat cover having means for retaining the plurality of sanitary covers making contact with the toilet seat cover, a toilet seat having means for clamping at least one of the plurality of sanitary covers upon the toilet seat cover making contact with the toilet seat, and means for positioning at least one of the plurality of sanitary covers upon the toilet seat.

According to a feature of an embodiment of the invention, the means for retaining the plurality of sanitary covers includes engaging pieces disposed on a forward portion of a lower side of the toilet seat cover, and a sanitary cover retaining section disposed on a rearward portion of the lower side of the toilet seat cover.

According to a feature of an embodiment of the invention, the means for retaining the plurality of sanitary covers includes the toilet seat cover having an upper cover and a bottom plate, the upper cover and bottom plate forming a sanitary cover storing portion, the upper cover being hingeably attached to a rear end of the toilet seat cover, the bottom plate extending from the rear end of the toilet seat cover to a guiding roller, the guiding roller extending laterally across a width of the toilet seat cover and connecting to the toilet seat approximately two thirds of a length of the toilet seat cover from the rear end of the toilet seat cover.

According to a feature of an embodiment of the invention, the means for clamping at least one of the plurality of sanitary covers includes a sanitary cover clamping section which includes an upper clamping member having a front portion and a rear portion, a lower clamping member having a front portion and a rear portion, a spring member, the upper clamping member being pivotally connected to the lower clamping member by a pivot pin, the spring member being disposed between the upper clamping member rear portion and the lower clamping member rear portion, the spring member holding the upper clamping member and the lower clamping member in a closed position whereby a portion of a lower area on the front portion of the upper clamping member and a portion of an upper area on the front portion of the lower clamping member make contact, the portion of the lower area on the front portion of the upper clamping member having a friction area disposed thereon, the portion of the upper area on the front portion of the lower clamping member having a friction area disposed thereon, the lower area on the front portion of the lower clamping member having an engaging portion disposed thereon, and the sanitary cover clamping section being attached to a forward bottom portion of the toilet seat.

According to a feature of an embodiment of the invention, the means for positioning at least one of the plurality of sanitary covers upon the toilet seat includes a sanitary cover holding section, which includes a holding portion having a front end, a sanitary cover presser resiliently formed from a part of an upper side of the holding portion, the holding portion front end being substantially rectangularly shaped and having an upper portion, a lower portion, and two side portions, a pin member being disposed on the upper portion and protruding downward and forward therefrom, at least one projecting portion mounted on at least one side portion of the holding portion front end, a functioning portion connected to the holding portion by an axial portion which has a supporting portion, a spring connected to and supported by the axial portion and making contact with a lower side of the toilet seat cover, and an engaging piece mounted on the functioning portion so that the engaging piece makes contact with the toilet seat upon the toilet seat cover making contact with the toilet seat.

According to a feature of an embodiment of the invention, a sanitary cover includes a sitting portion having a shape similar to a toilet seat, a belt portion bridging the sitting portion along a front-to-rear direction, and a clamp portion axially aligned with the belt portion and extending from a front of the sitting portion.

According to a feature of an embodiment of the invention, the belt portion has a front end nearest to the clamp portion and a rear end farthest from the clamp portion, the belt portion rear end has lateral perforations, and the belt portion increases in width from the front end to the rear end.

According to a feature of an embodiment of the invention, the clamp portion has a pin hole and an engaging hole, a right side of the sitting portion has an engaging hole, and a left side of the sitting portion has an engaging hole.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4 is an exploded perspective view of a sanitary cover clamping section of a toilet seat according to an embodiment of the present invention.

FIG. 5*a* is a side view of a sanitary cover holding section of a device for providing sanitary covers for toilet seats according to an embodiment of the present invention.

FIG. 5*b* is a side view of a sanitary cover clamping section of a device for providing sanitary covers for toilet seats according to an embodiment of the present invention.

DETAILED DESCRIPTION OF THE INVENTION

Figure 1:
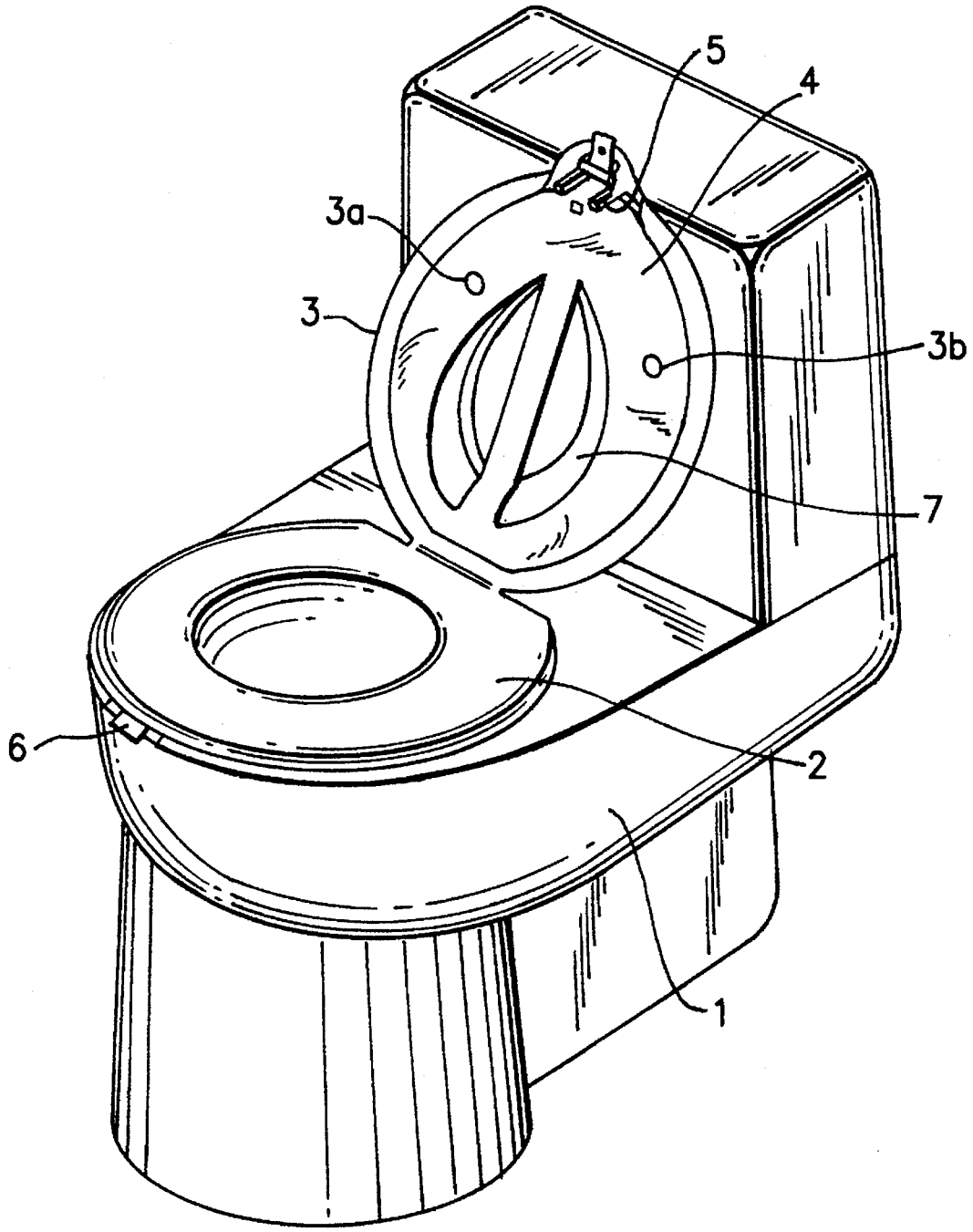
FIG. 1 is a perspective view of a toilet seat equipped with a device for providing toilet seat sanitary covers according to an embodiment of the present invention.

Referring to FIG. 1, a device for providing toilet seat sanitary covers is shown. On an upper portion of a standard toilet 1, a toilet seat 2 is mounted which can be opened and closed with its rear portion affixed by a pivot. On the upper portion of toilet seat 2, a toilet seat cover 3 is mounted which can be opened and closed with its rear portion affixed concentrically with toilet seat 2.

Inside toilet seat cover 3, a plurality of toilet seat sanitary covers 4, are stored which have been cut in a predetermined shape. In the underside portion of toilet seat cover 3, a sanitary cover holding section 5, which also serves as a sanitary cover guiding means, is mounted. Sanitary covers 4 are kept in sanitary cover retaining section 7 of toilet seat cover 3 and are held in place by engaging pieces 3*a* and 3*b* as well as sanitary cover holding section 5. At a front portion of toilet seat 2, a sanitary cover clamping section 6 is disposed which clamps a portion of a sanitary cover 4 when toilet seat cover 3 is closed.

Figure 2:
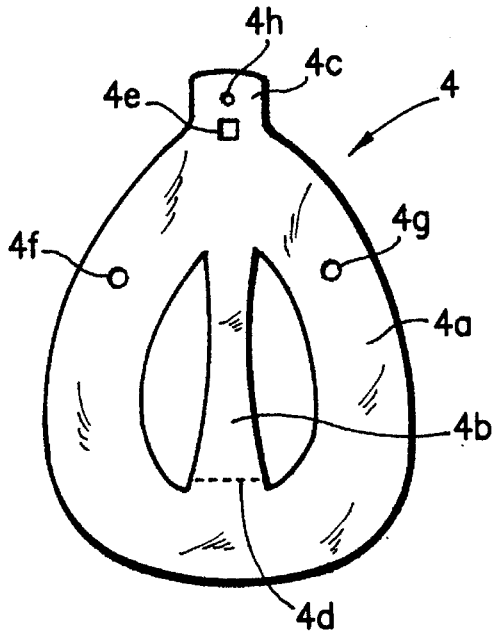
FIG. 2 is a front view of a toilet seat sanitary cover according to an embodiment of the present invention.

Referring also to FIG. 2, sanitary cover 4 has a sitting portion 4*a* which has a shape similar to toilet seat 2, and a belt portion 4*b* which bridges sitting portion 4*a* along the front-to-rear direction of toilet seat 2. A clamp portion 4*c* in convex plate shape is formed as a portion of sitting portion 4*a* and axially aligned with belt portion 4*b*. Clamp portion 4*c* is caught by sanitary cover clamping section 6. At an end of belt portion 4*b* furthest from clamp portion 4*c*, a perforation 4*d* is made which laterally crosses the width of belt portion 4*b*. Belt portion 4*b* becomes wider as it approaches the site of perforation 4*d*. At clamp portion 4*c*, a pin hole 4*h* is disposed which engages a pin member 16 of sanitary cover holding section 5. In this embodiment, sanitary covers 4 are made from water-soluble materials.

Engaging holes 4*e*, 4*f*, and 4*g* are formed in sitting portion 4*a*. Engaging hole 4*e* is engaged by sanitary cover presser 17 of sanitary cover holding section 5, and engaging holes 4*f* and 4*g* are engaged and supported by engaging pieces 3*a* and 3*b*. Sanitary cover retaining section 7, which covers approximately the bottom half of toilet seat cover 3, is disposed in order to assure that a plurality of sanitary covers 4 are kept inside toilet seat cover 3. Sanitary cover retaining section 7 also prevents sanitary covers 4 from being stained when a toilet is used by both women and men. Sanitary cover retaining section 7 is preferably made of waterproof or water resistant material.

Figure 3:
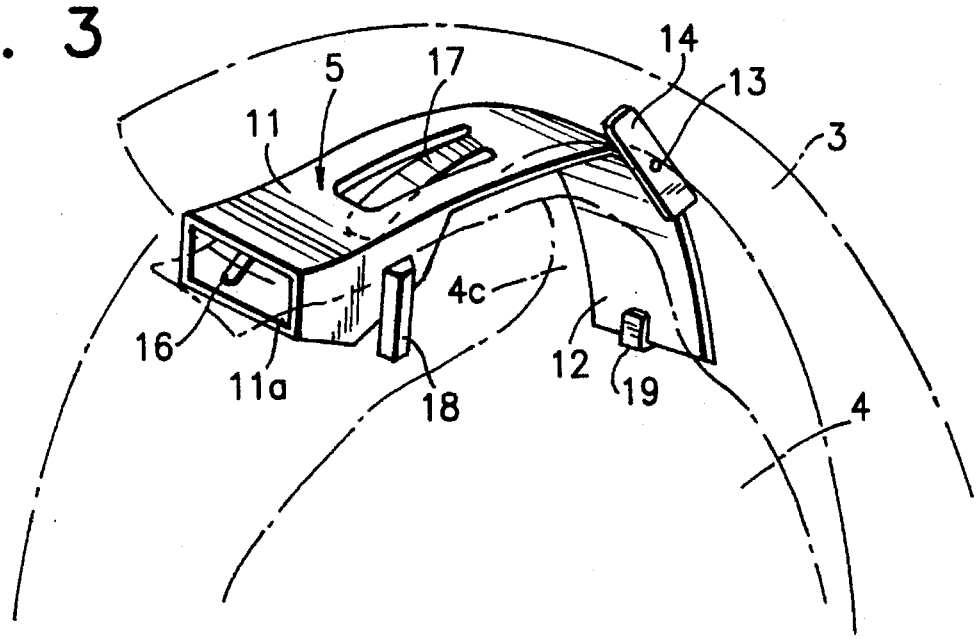
FIG. 3 is a perspective view of a sanitary cover holding section of a toilet seat cover according to an embodiment of the present invention.
Figure 6:
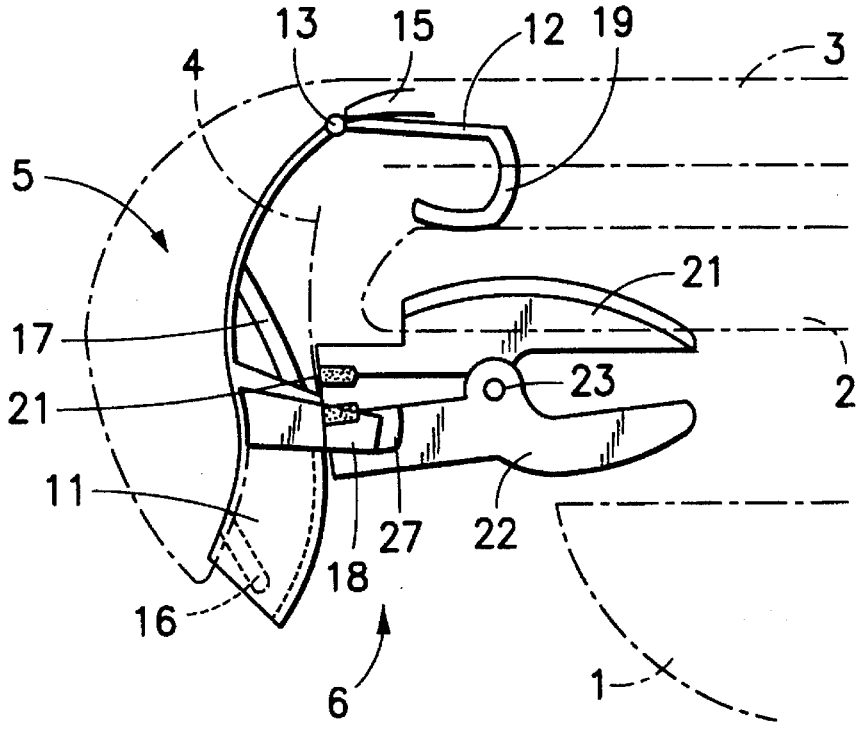
FIG. 6 is a side view of the sanitary cover holding section of FIG. 5*a* and the sanitary cover clamping section of FIG. 5*b* making contact according to an embodiment of the present invention.
Figure 7:
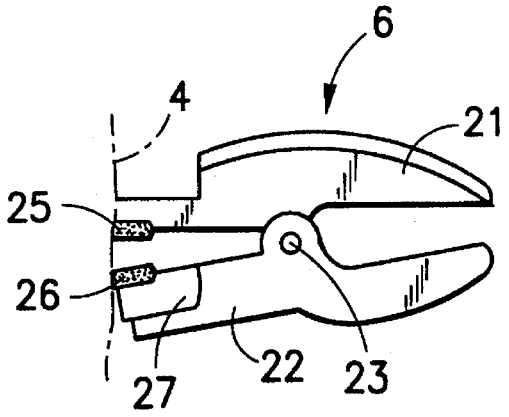
FIG. 7 is a side view of the sanitary cover clamping section as shown in FIG. 6.
Figure 8A:
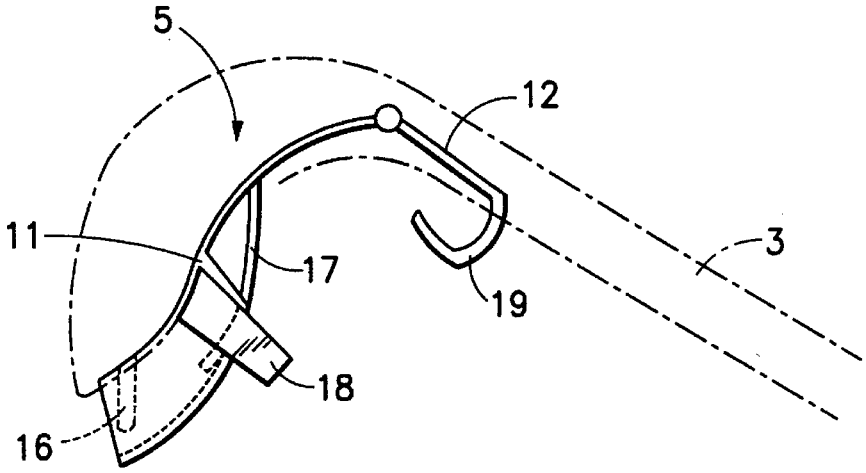
FIG. 8*a* is a side view of the sanitary cover holding section after a sanitary cover has been caught and released.
Figure 8B:
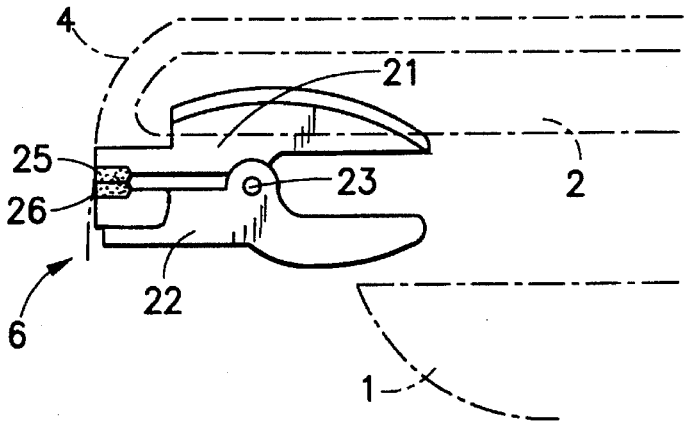
FIG. 8*b* is a side view of the sanitary cover clamping section after a sanitary cover has been caught.

Referring to FIGS. 3–5, sanitary cover holding section 5 includes a holding portion 11 and a functioning portion 12. Holding portion 11 holds clamp portion 4*c* while functioning portion 12 moves holding portion 11 toward sanitary cover clamping section 6 when toilet seat cover 3 is closed or when toilet seat 2 is raised against toilet seat cover 3. Sanitary cover holding section 5 is freely movable and is pivotally mounted on a supporting portion 14. Supporting portion 14 is formed inside toilet seat cover 3 by an axial portion 13 which connects holding portion 11 and functioning portion 12. Between the inside of toilet seat cover 3 and the back of functioning portion 12, a spring 15 is disposed and supported by axial portion 13. Sanitary cover holding section 5 has functioning portion 12 disposed outward from the inside of toilet seat cover 3.

A front end 11*a* of holding portion 11 is shaped like a rectangular box. Clamp portion 4*c* is inserted into front end 11*a*. Inside holding portion 11, near front end 11*a*, a pin member 16 is disposed on an upper side pointing downward and forward. Pin member 16 penetrates pin hole 4*h* of sanitary covers 4. Pin member 16 helps hold sanitary covers 4 and dispenses sanitary covers 4 sanitary cover by sanitary cover. At approximately the center of holding portion 11, a sanitary cover presser 17 is formed as a spring from part of the upper side of holding portion 11 to press sanitary covers 4 away from toilet seat cover 3.

A projecting portion 18 is mounted on each side of holding portion 11 to push and open sanitary cover clamping section 6 when toilet seat cover 3 and toilet seat 2 make contact. An engaging piece 19 is mounted on functioning portion 12 to engage engaging hole 4*e* and to make contact with the top of toilet seat 2 when toilet seat cover 3 is closed or when toilet seat 2 is raised against toilet seat cover 3. Engaging piece 19 thus controls the relative vertical positioning of toilet seat cover 3 and toilet seat 2 during contact.

Sanitary cover clamping section 6 includes clamping members 21 and 22 which are pivotally connected by pivot pin 23 and can be opened and closed. Spring member 24, which is disposed between the rear portions of clamping members 21 and 22, holds them in a closed condition. Rubber plates 25 and 26 are affixed to the inside opposing surfaces of front end portions of clamping members 21 and 22. Any material having a high coefficient of friction can be affixed instead. Rubber plates 25 and 26 clamp the clamp portion 4*c* of sanitary cover 4. At the two front side portions of clamping member 22, an engaging portion 27 is formed to engage projecting portion 18 of sanitary cover holding section 5. The top of clamping member 21 of sanitary cover clamping section 6 is attached to the bottom of toilet seat 2.

Referring to FIGS. 5*a* to 8*b*, when a raised toilet seat cover 3 is lowered onto toilet seat 2, the bottom of engaging piece 19 of functioning portion 12 of sanitary cover holding section 5 makes contact with the top of toilet seat 2. Since functioning portion 12 moves upward against the force of spring 15, holding portion 11 of sanitary cover holding section 5 moves down and makes contact with sanitary cover clamping section 6.

Accordingly, the front end of projecting portion 18 engages engaging portion 27 of clamping member 22 of sanitary cover clamping section 6. The front end of projecting portion 18 moves downward against the force of spring member 24 and clamping members 21 and 22 are opened. Projecting portion 18 also serves to guide sanitary cover holding section 5 to a position where clamp portion 4*c* of the next sanitary cover 4 makes contact with the front end of rubber plates 25 and 26 of clamping members 21 and 22.

When toilet seat cover 3 is then raised, the front end of projecting portion 18 is released from engaging portion 27. Subsequently, clamping members 21 and 22 close because of the force of spring member 24. At this moment, clamp portion 4*c* is taken into the space between clamping members 21 and 22 and caught. As toilet seat cover is raised further, a sanitary cover 4 with its clamp portion 4*c* caught by clamping members 21 and 22 is separated from toilet seat cover 3 and positioned on toilet seat 2.

In the event that toilet seat 2 is raised against toilet seat cover 3 and lightly pressed, the same clamping action occurs, and as toilet seat 2 is lowered, the caught sanitary cover 4 is separated from toilet seat cover 3 and positioned on toilet seat 2.

When a toilet user sits on toilet seat 2, the rear portion of clamping member 22 is pressed against toilet 1, and clamping members 21 and 22 become open. Clamp portion 4*c* of toilet seat sanitary cover 4 is no longer clamped between clamping members 21 and 22. Accordingly, by human discharge, belt portion 4*b* of toilet seat sanitary cover 4 is cut off at perforation 4*d*, and sanitary cover 4 is flushed away by the flushing water of toilet 1 when the toilet user leaves toilet seat 2. In a continuously flushing toilet, sanitary cover 4 is flushed away as soon as the toilet user leaves toilet seat 2. Otherwise, sanitary cover 4 is flushed away when the toilet user flushes the toilet 1.

Utilizing the present invention in this manner, lowering toilet seat cover 3 causes clamp portion 4*c* of sanitary cover 4 to be caught by sanitary cover clamping section 6, and then raising toilet seat cover 3 causes sanitary cover 4 to be left on toilet seat 2. A toilet seat sanitary cover can thus be provided and set on toilet seat by a simple "one-touch" operation. Since no power driving sources are required, the structure is simple and can be easily maintained. In addition, the present invention can be adapted easily for use with existing toilets since it only requires changing a toilet seat cover and installing a sanitary cover clamping section to a toilet seat.

The present invention is not limited to the embodiment described above. If a toilet seat is U-shaped instead of O-shaped, two toilet seat sanitary cover clamping sections can be mounted on both front sections of the toilet seat.

Figure 9:
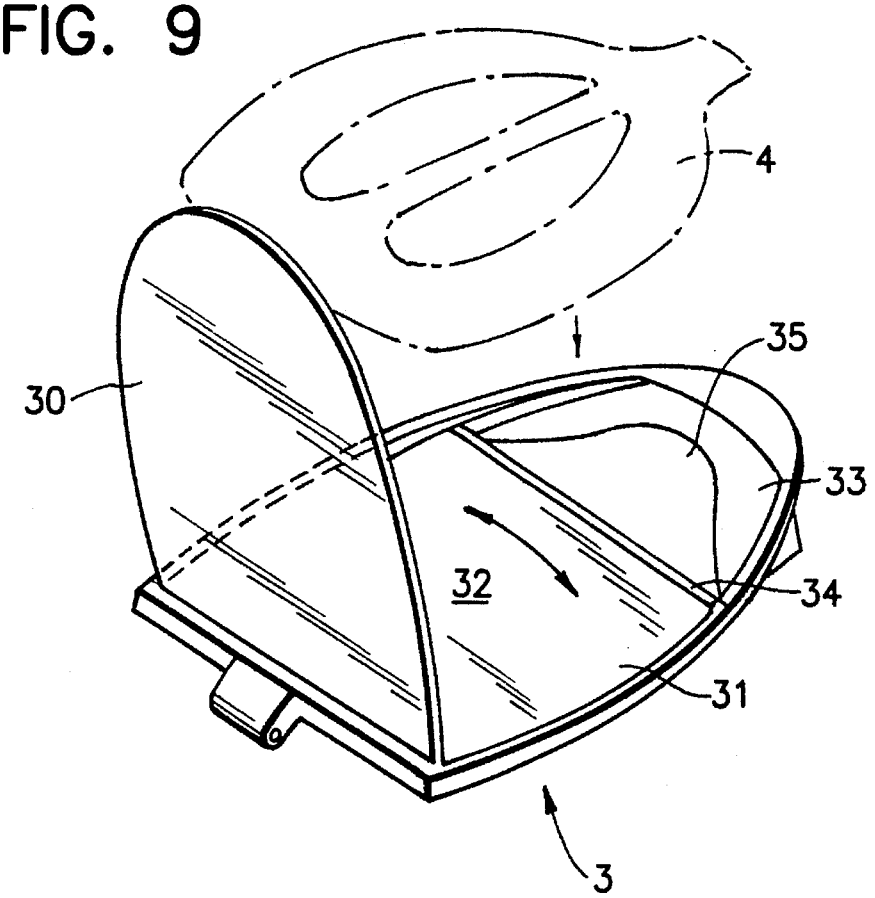
FIG. 9 is a perspective view of a toilet seat cover with its upper cover opened according to another embodiment of the present invention.
Figure 10:
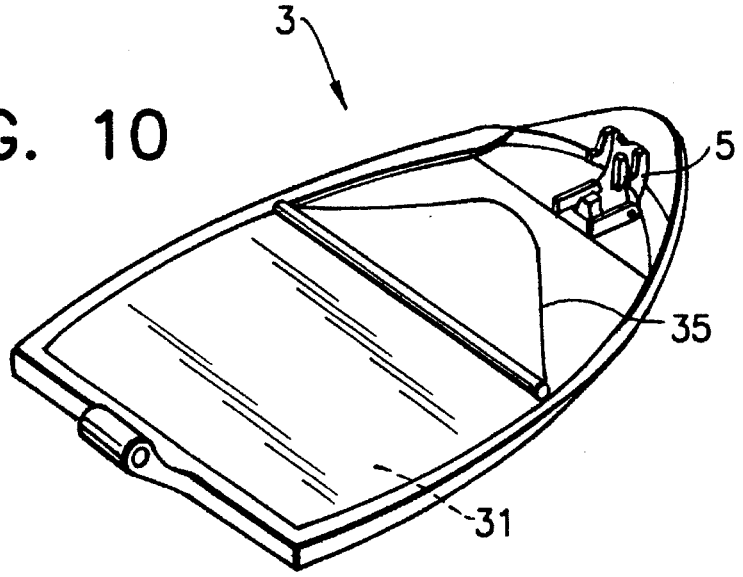
FIG. 10 is a perspective view showing the inside of a toilet seat cover according to the embodiment of the present invention depicted in FIG. 9.
Figure 11:
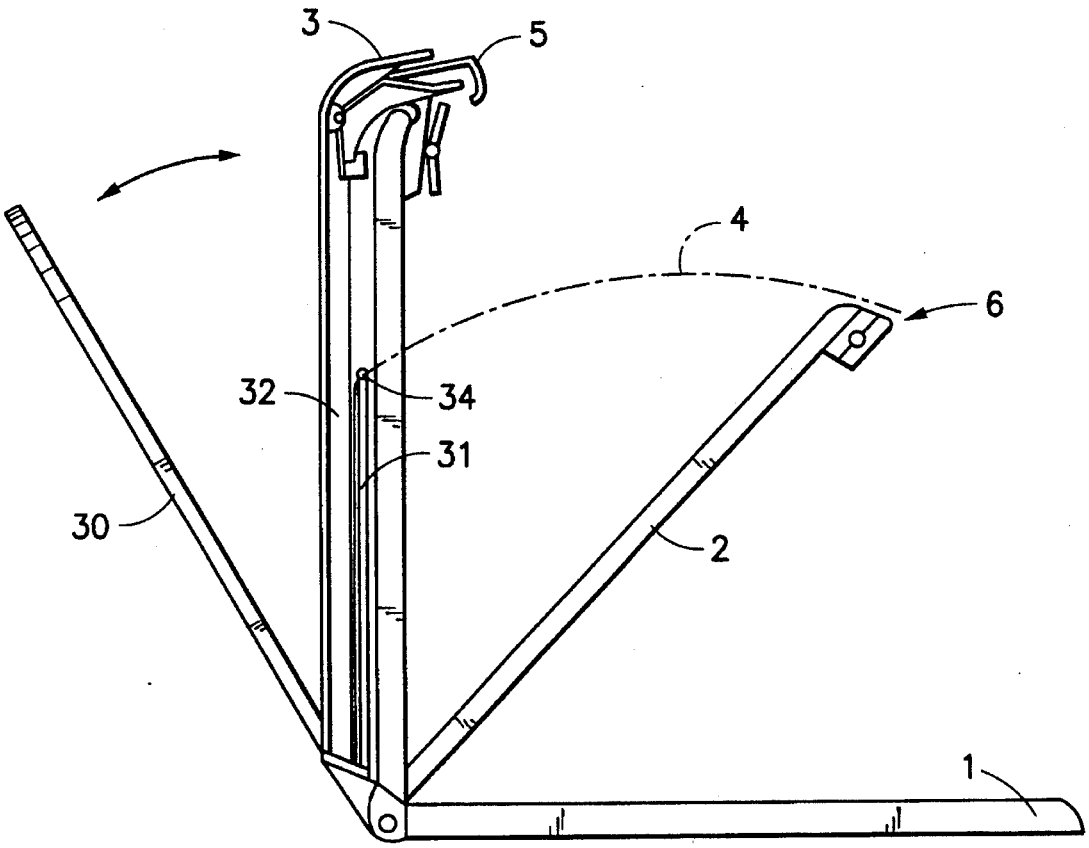
FIG. 11 is a side view showing the operation of the embodiment of the present invention depicted in FIG. 9.

Referring to FIGS. 9–11, an alternative embodiment is shown for storing sanitary covers 4 in toilet seat 3. Toilet seat cover 3 includes an upper cover 30 which can be opened and closed freely and a bottom plate 31 which keeps sanitary covers inside the toilet seat cover 3. A sanitary cover storing portion 32 is formed in the space between upper cover 30 and bottom plate 31. Bottom plate 31 extends approximately two thirds of the length of toilet seat cover 3, and a guiding roller 34 extends across toilet seat cover 3 at the end of bottom plate 31. Guiding roller 34 guides and assists sanitary cover 4 as it is pulled out from sanitary cover storing portion 32. Waterproof cover 35 is mounted in opening portion 33 to keep the front portions of the sanitary covers dry. When upper cover 30 is opened, a plurality of stacked sanitary covers 4 are stored in sanitary cover storing portion 32. The interaction between toilet seat cover 3 and toilet seat 2 is the same as previously described. Sanitary covers can be loaded through the upper side of the toilet seat cover instead of from the lower side as in the preferred embodiment.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for providing at least one of a plurality of sanitary covers for a toilet seat, comprising:

a toilet seat cover having means for retaining said plurality of sanitary covers in contact with said toilet seat cover;

a toilet seat having means for clamping at least one of said plurality of sanitary covers upon said toilet seat cover making contact with said toilet seat;.

said means for clamping said at least one of said plurality of sanitary covers including a sanitary cover clamping section;

said sanitary cover clamping section further including an upper clamping member having a front portion and a rear portion;

a lower clamping member having a front portion and a rear portion;

a spring member;

said upper clamping member being pivotally connected to said lower clamping member by a pivot pin;

said spring member being disposed between said upper clamping member rear portion and said lower clamping member rear portion;

said spring member holding said upper clamping member and said lower clamping member in a closed position whereby a portion of a lower area on said front portion of said upper clamping member and a portion of an upper area on said front portion of said lower clamping member make contact;

said portion of said lower area on said front portion of said upper clamping member having a friction area disposed thereon;

said portion of said upper area on said front portion of said lower clamping member having a friction area disposed thereon;

said lower area on said front portion of said lower clamping member having an engaging portion disposed thereon;

said sanitary cover clamping section being attached to a forward bottom portion of said toilet seat; and means for positioning said at least one of said plurality of sanitary covers upon said toilet seat.

2. A device according to claim 1, wherein said means for retaining said plurality of sanitary covers comprises:

engaging pieces disposed on a lower side of said toilet seat cover in a forward portion of said lower side of said toilet seat cover; and a sanitary cover retaining section disposed on a lower side of said toilet seat cover in a rearward portion of said lower side of said toilet seat cover.

3. A device according to claim 2, wherein said sanitary cover retaining section comprises one of a waterproof and water resistant material.

4. A device according to claim 1, wherein said means for retaining said plurality of sanitary covers comprises:

said toilet seat cover having an upper cover and a bottom plate;

said upper cover and said bottom plate forming a sanitary cover storing portion;

said upper cover being hingeably attached to a rear end of said toilet seat cover;

said bottom plate extending from said rear end of said toilet seat cover to a guiding roller;

said guiding roller extending laterally across a width of said toilet seat cover; and said guiding roller connecting to said toilet seat approximately two thirds of a length of said toilet seat cover from said rear end of said toilet seat cover.

5. A device according to claim 4, further comprising one of a waterproof and water resistant cover attached to said bottom plate at a location where said guiding roller extends laterally across said width of said toilet seat cover and extending substantially parallel to said bottom plate.

6. A device according to claim 1, wherein said means for positioning said at least one of said plurality of sanitary covers upon said toilet seat comprises a sanitary cover holding section.

7. A device according to claim 1, wherein said at least one of a plurality of sanitary covers comprises:

a sitting portion having a shape similar to a toilet seat;

a belt portion bridging said sitting portion along a front-to-rear direction; and a clamp portion axially aligned with said belt portion and extending from a front of said sitting portion.

8. A sanitary cover according to claim 7, wherein:

said belt portion has a front end nearest to said clamp portion and a rear end farthest from said clamp portion;

said belt portion rear end has lateral perforations; and said belt portion increases in width from said front end to said rear end.

9. A sanitary cover according to claim 7, wherein:

said clamp portion has a pin hole and an engaging hole;

a right side of said sitting portion has an engaging hole; and a left side of said sitting portion has an engaging hole.

10. A device for providing at least one of a plurality of sanitary covers for a toilet seat, comprising:

a toilet seat cover having means for retaining said plurality of sanitary covers in contact with said toilet seat cover;

a toilet seat having means for clamping at least one of said plurality of sanitary covers upon said toilet seat cover making contact with said toilet seat;

said means for clamping said at least one of said plurality of sanitary covers including a sanitary cover clamping section;

said sanitary cover clamping section further including an upper clamping member having a front portion and a rear portion;

a lower clamping member having a front portion and a rear portion;

a spring member;

said upper clamping member being pivotally connected to said lower clamping member by a pivot pin;

said spring member being disposed between said upper clamping member rear portion and said lower clamping member rear portion;

said spring member holding said upper clamping member and said lower clamping member in a closed position whereby a portion of a lower area on said front portion of said upper clamping member and a portion of an Upper area on said front portion of said lower clamping member make contact;

said portion of said lower area on said front portion of said upper clamping member having a friction area disposed thereon;

said portion of said upper area on said front portion of said lower clamping member having a friction area disposed thereon;

said lower area on said front portion of said lower clamping member having an engaging portion disposed thereon; and said sanitary cover clamping section being attached to a forward bottom portion of said toilet seat;

said friction areas including one of rubber plates and other material having a high coefficient of friction;

means for positioning said at least one of said plurality of sanitary covers upon said toilet seat;

said means for positioning said at least one of said plurality of sanitary covers upon said toilet seat including a sanitary cover holding section; and said sanitary cover holding section further including a holding portion having a front end;

a sanitary cover presser resiliently formed from a part of an upper side of said holding portion;

said holding portion front end being substantially rectangularly shaped and having an upper portion, a lower portion, and two side portions;

a pin member being disposed on said upper portion and protruding downward and forward therefrom;

at least one projecting portion mounted on at least one side portion of said holding portion front end;

a functioning portion connected to said holding portion by an axial portion;

said axial portion having a supporting portion;

a spring connected to and supported by said axial portion;

said spring making contact with a lower side of said toilet seat cover; and an engaging piece mounted on said functioning portion so that said engaging piece makes contact with said toilet seat upon said toilet seat cover making contact with said toilet seat.

11. A device for providing at least one of a plurality of sanitary covers for a toilet seat, comprising:

a toilet seat cover having means for retaining said plurality of sanitary covers in contact with said toilet seat cover;

a toilet seat having means for clamping at least one of said plurality of sanitary covers upon said toilet seat cover making contact with said toilet seat;

said means for clamping said at least one of said plurality of sanitary covers including a sanitary cover clamping section;

said sanitary cover clamping section further including an upper clamping member having a front portion and a rear portion;

a lower clamping member having a front portion and a rear portion;

a spring member;

said upper clamping member being pivot ally connected to said lower clamping member by a pivot pin;

said spring member being disposed between said upper clamping member rear portion and said lower clamping member rear portion;

said spring member holding said upper clamping member and said lower clamping member in a closed position whereby a portion of a lower area on said front portion of said upper clamping member and a portion of an upper area on said front portion of said lower clamping member make contact;

said portion of said lower area on said front portion of said upper clamping member having a friction area disposed thereon;

said portion of said upper area on said front portion of said lower clamping member having a friction area disposed thereon;

said lower area on said front portion of said lower clamping member having an engaging portion disposed thereon; and said sanitary cover clamping section being attached to a forward bottom portion of said toilet seat;

said friction areas including one of rubber plates and other material having a high coefficient of friction; and means for positioning said at least one of said plurality of sanitary covers upon said toilet seat.

* * * * *